US007690833B2

(12) United States Patent
Metcalfe, III et al.

(10) Patent No.: US 7,690,833 B2
(45) Date of Patent: Apr. 6, 2010

(54) HEAT EXCHANGE METHOD AND APPARATUS UTILIZING CHAOTIC ADVECTION IN A FLOWING FLUID TO PROMOTE HEAT EXCHANGE

(75) Inventors: Guy Parker Metcalfe, III, Victoria (AU); Murray Rudman, Victoria (AU)

(73) Assignee: Commonwealth Scientific and Industrial Research Organisation, Austrailan Capital Territory (AU)

( * ) Notice: Subject to any disclaimer, the term of this patent is extended or adjusted under 35 U.S.C. 154(b) by 726 days.

(21) Appl. No.: 11/513,065

(22) Filed: Aug. 31, 2006

(65) Prior Publication Data

US 2007/0127310 A1 Jun. 7, 2007

Related U.S. Application Data

(63) Continuation-in-part of application No. 10/363,920, filed as application No. PCT/AU01/01127 on Sep. 7, 2001, now Pat. No. 7,121,714.

(60) Provisional application No. 60/231,358, filed on Sep. 8, 2000.

(51) Int. Cl.
*B01F 5/06* (2006.01)
*B01F 9/02* (2006.01)
*B01F 15/06* (2006.01)

(52) U.S. Cl. ..... 366/146; 366/149; 366/175.1; 366/226; 366/230; 366/305; 366/338; 165/109.1

(58) Field of Classification Search ..... 366/144–146, 366/149, 175.1, 175.3, 176.1, 181.5, 226, 366/230, 231, 305, 336–340; 432/112–114; 165/86, 89, 90, 109.1
See application file for complete search history.

(56) References Cited

U.S. PATENT DOCUMENTS 2,747,844 A * 5/1956 Slayter ..... 366/167.1
4,048,473 A * 9/1977 Burkhart ..... 219/389
4,191,530 A * 3/1980 Bearce ..... 432/107
4,296,072 A * 10/1981 Takacs et al. ..... 422/254
4,482,254 A * 11/1984 Kessler et al. ..... 366/181.4

(Continued)

FOREIGN PATENT DOCUMENTS

DE 363 4254 A1 4/1988

(Continued)

OTHER PUBLICATIONS

Derwent Abstract Accession No. 98-163048/15, JP 10029213 a (Dow Corning Toray Silicone), Feb. 3, 1998.

*Primary Examiner*—Charles E Cooley
(74) *Attorney, Agent, or Firm*—Sughrue Mion, PLLC

(57) ABSTRACT

A heat exchanger is disclosed which includes an elongate fluid duct having a series of openings and an outer sleeve disposed outside and extending along the duct to cover the openings. A drive motor is provided for imparting relative motion between the duct and the sleeve so that the sleeve moves across the openings in the peripheral wall of the duct. A temperature control device which may include an outer jacket arranged about the sleeve to define a chamber for receiving a heat exchange fluid, an electric heating element for supplying current to the outer sleeve or duct to heat the outer sleeve or duct, a series of burners for heating the outer surface of the sleeve, or a heating element incorporated in one of the duct and sleeve.

18 Claims, 6 Drawing Sheets

U.S. PATENT DOCUMENTS 4,599,208 A * 7/1986 Blaak ..... 261/83
4,886,368 A * 12/1989 King ..... 366/155.1
4,915,509 A * 4/1990 Sauer et al. ..... 366/171.1
5,205,647 A * 4/1993 Ricciardi ..... 366/328.2
5,333,952 A * 8/1994 Perdue ..... 366/336
5,450,368 A * 9/1995 Kubota ..... 366/303
5,538,343 A * 7/1996 Tynan ..... 366/305
5,597,236 A * 1/1997 Fasano ..... 366/181.5
6,074,085 A * 6/2000 Scarpa et al. ..... 366/101
6,386,751 B1 * 5/2002 Wootan et al. ..... 366/170.3
7,121,714 B2 * 10/2006 Metcalfe et al. ..... 366/175.1
2004/0013034 A1 * 1/2004 Metcalfe, III et al. ..... 366/230
2007/0127310 A1 * 6/2007 Metcalfe et al. ..... 366/230

FOREIGN PATENT DOCUMENTS

EP 040 16 14 A1 12/1990
EP 620039 A 10/1994

* cited by examiner

HEAT EXCHANGE METHOD AND APPARATUS UTILIZING CHAOTIC ADVECTION IN A FLOWING FLUID TO PROMOTE HEAT EXCHANGE

RELATED APPLICATION

This is a Continuation-in-Part Application of Application Ser. No. 10/363,920 filed Aug. 8, 2003, now U.S. Pat. No. 7,121,714 B2, issued Oct 17, 2006, which is a National Stage entry of PCT/AU01/01127 filed Sep 7, 2001, and claims benefit from U.S. Provisional Application Ser. No. 60/231,358 filed Sep 8, 2000 and Australian Application No. 2006902340 filed May 4, 2006 in the Australian Patent Office, the entire disclosures of which are considered part of the disclosure of the accompanying Continuation-In-Part application and are hereby incorporated by reference.

FIELD OF THE INVENTION

The present invention relates to a heat exchanger. In particular, but not exclusively, the present invention is a modification and new application of the fluid mixer disclosed in our International patent application No. PCT/AU01/01127. The contents of that International application are incorporated into this specification by this reference.

BACKGROUND OF THE INVENTION

The fluid mixer disclosed in the above International application is in the form of a rotated arc mixer which uses programmed flow reorientation to provide chaotic fluid motion that allows two or more fluid materials to be well-mixed in an efficient manner.

SUMMARY OF THE INVENTION

The inventors have now found that a heat exchanger can be produced based on the concepts of the mixer disclosed in the above application, which therefore provide applications unforseen in relation to the mere mixing of two fluids.

In a first aspect, the present invention may therefore be said to reside in a heat exchanger comprising:

- an elongate fluid flow duct having a peripheral wall provided with a series of openings;
- an outer sleeve disposed outside and extending along the duct to cover said openings in the wall of the fluid flow duct;
- a duct inlet for admission into the duct of a fluid;
- a duct outlet for outlet of the fluid;
- a drive for imparting relative motion between the duct and the sleeve, such that parts of the sleeve move across the openings in the peripheral wall of the duct; and
- a temperature control device for heating or cooling at least one of the outer sleeve and inner duct so that the fluid is subjected to heat exchange.

Preferably the relative movement between the duct and the sleeve causes relative movement between the openings and a peripheral wall of the sleeve and those parts of the sleeve covering the openings in directions across the openings to create viscous drag on the fluid within the duct to generate transverse peripheral flows of fluid within the duct simultaneously in the vicinity of the openings.

The heat exchange can take place in the regions of the openings and also across the sleeve into the fluid within the sleeve.

Preferably the duct and inner peripheral surface of the outer sleeve are of concentric cylindrical configuration.

Preferably the outer sleeve is of circular cylindrical form.

Preferably the drive is a motor for rotating one of the duct and the outer sleeve.

Preferably the openings are in the form of arcuate windows extending circumferentially of the duct.

Preferably each window is of constant width in the longitudinal direction of the duct.

Preferably the windows are disposed in an array in which successive windows are staggered both longitudinally and circumferentially of the duct.

Successive windows may overlap one another circumferentially of the duct.

Preferably a series of said windows is disposed at regular circumferential angular spacings about the duct.

Preferably the series of windows is one of a plurality of such series in which the windows of each series are disposed at equal angular spacings, but there is a differing angular spacing between the last window of one series and the first window of a succeeding series.

In one embodiment the temperature control device comprises an outer jacket arranged about the sleeve to define a chamber between the jacket and the outer sleeve, the chamber having an inlet for receiving a heat exchange fluid to control the temperature of the outer sleeve, and an outlet for discharge of the heat exchange fluid.

In this embodiment, if the nature of the heat exchanger is such that the temperature of the fluid passing through the duct is to be heated, the heat exchange fluid supplied to the chamber is a heated fluid to heat the sleeve so that heat exchange occurs between the sleeve and the fluid to in turn heat the fluid in the duct.

If the nature of the heat exchanger is such that the fluid in the duct is to be cooled, a coolant fluid is supplied to the chamber so that the heat exchange between the fluid at the openings and the cooled outer sleeve causes a cooling of the fluid in the duct.

Preferably a plurality of baffles are arranged between the jacket and the sleeve to cause the heat exchange fluid to traverse around the baffles and therefore to make good contact with the sleeve during passage of the heat exchange fluid in the chamber.

In a second embodiment the temperature control comprises an electric heating element for supplying electric current to one of the outer sleeve or the duct to heat the said one of the outer sleeve and duct by ohmic resistance of the outer sleeve or duct.

This embodiment provides for heating only, as the outer sleeve or duct is heated by the ohmic resistance to in turn provide heat exchange to the fluid in the duct.

In a third embodiment of the invention the temperature control device could be in the form of a series of burners for providing flames of varying intensities along the outer surface of the outer sleeve.

In a fourth embodiment an electric heating element may be incorporated in one of the duct and sleeve.

In still further embodiments other forms of heating or cooling the outer sleeve or duct could be used.

Whilst in the preferred embodiment the openings are in the form of arcuate windows, the openings may have other shapes and may be of different sizes and offset by different amounts.

In the preferred embodiment of the invention the duct is rotated and the outer sleeve is stationary. However, the duct could be rotated and the nature of the relative motion between the duct and outer sleeve could be an oscillatory or reciprocating motion in the axial direction of the outer sleeve and duct. Such a motion is most preferred in embodiments where the outer sleeve and duct are other than cylindrical in shape.

In a first aspect, the present invention may also be said to reside in a heat exchange method:

providing a fluid flow through an elongate fluid flow duct having a peripheral wall provided with a series of openings, and encased in an outer sleeve disposed outside and extending along the duct to cover said openings in the wall of the fluid flow duct;

imparting relative motion between the duct and the sleeve, such that parts of the sleeve move across the openings in the peripheral wall of the duct; and controlling the temperature of at least one of the outer sleeve and duct so that the fluid is subjected to heat exchange.

Preferably the relative movement between the duct and the sleeve causes relative movement between the openings and a peripheral wall of the sleeve and those parts of the sleeve covering the openings in directions across the openings to create viscous drag on the fluid within the duct to generate transverse peripheral flows of fluid within the duct simultaneously in the vicinity of the openings.

The heat exchange may take place in the regions of the openings and also across the sleeve into the fluid within the sleeve.

Preferably the duct and inner peripheral surface of the outer sleeve are of concentric cylindrical configuration.

Preferably the outer sleeve is of circular cylindrical form.

Preferably the drive is a motor for rotating one of the duct and the outer sleeve.

Preferably the openings are in the form of arcuate windows extending circumferentially of the duct.

Preferably each window is of constant width in the longitudinal direction of the duct.

Preferably the windows are disposed in an array in which successive windows are staggered both longitudinally and circumferentially of the duct.

Successive windows may overlap one another circumferentially of the duct.

Preferably a series of said windows is disposed at regular circumferential angular spacings about the duct.

Preferably the series of windows is one of a plurality of such series in which the windows of each series are disposed at equal angular spacings, but there is a differing angular spacing between the last window of one series and the first window of a succeeding series.

In one embodiment the temperature control takes place by arranging an outer jacket about the sleeve to define a chamber between the jacket and the outer sleeve, and supplying a heat exchange fluid to the chamber to control the temperature of the outer sleeve.

In a second embodiment the temperature control takes place by supplying an electric current to one of the outer sleeve or the duct to heat the said one of the outer sleeve and duct by ohmic resistance of the outer sleeve or duct.

In a third embodiment of the invention the temperature control is provided by a series of burners for providing flames of varying intensities along the outer surface of the outer sleeve.

BRIEF DESCRIPTION OF THE DRAWINGS

Preferred embodiments of the invention will be described, by way of example, with reference to the accompanying drawings in which.

DESCRIPTION OF THE PREFERRED EMBODIMENTS

Figure 1:
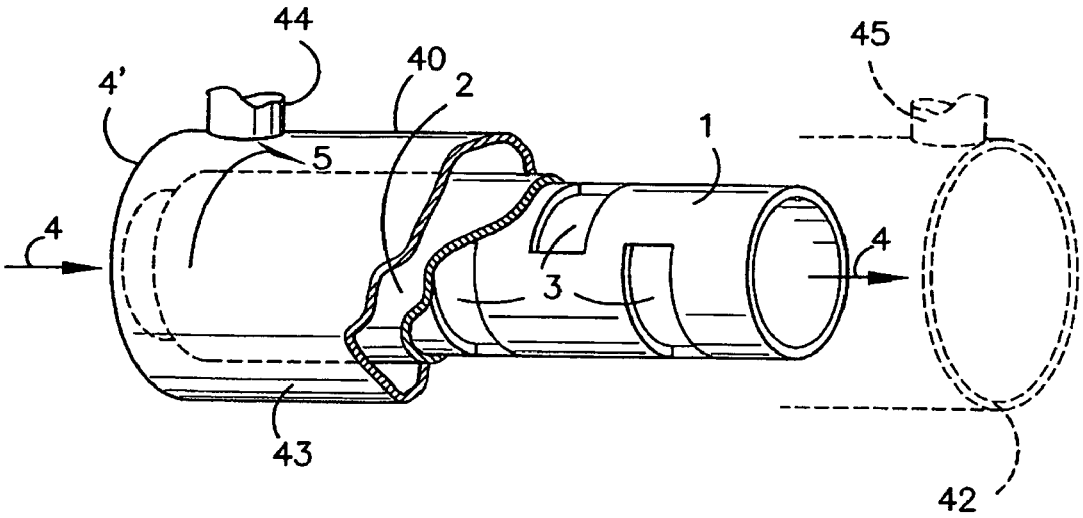
FIG. 1 is a schematic cut-away diagram of a first embodiment of the invention.

FIG. 1 depicts a stationary inner cylinder 1 surrounded by an outer rotatable cylinder 2. The inner cylinder 1 has windows 3 cut into its wall. A fluid to be heated or cooled is passed through the inner cylinder 1 in the direction of arrow 4 and the rotatable outer cylinder 2 is rotated anti-clockwise in the direction indicated by the arrow 5. For convenience, rotation in an anticlockwise direction is accorded a positive angular velocity and rotation in a clockwise direction is accorded a negative angular velocity in subsequent description. In other embodiments the inner cylinder 1 may be rotated and the outer cylinder 2 is stationary.

Figure 2:
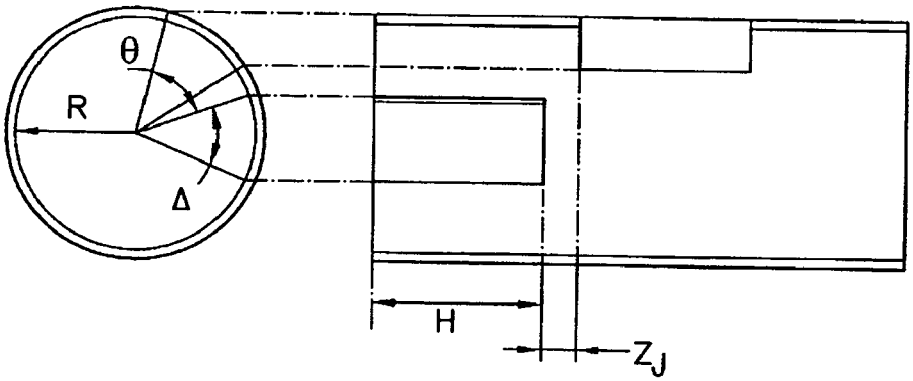
FIG. 2 is a view of an inner sleeve of the embodiment of FIG. 1.

As shown in FIG. 2, the geometric design parameters of the mixer are as follows:

(i) R —The nominal radius of the device (meters) is the inner radius of the conduit (ii) Δ—The angular opening of each window (radians)

(iii) Θ—The angular offset between subsequent windows (angle from the start of one window to the start of the subsequent window, radians)

(iv) H —The axial extent of each window (meters) (V) $Z_J$—The axial window gap;, or distance from the end of one window to the start of the next (can be negative, meters)

(vi) N —The number of windows.

In addition to the geometric parameters, there are several operational parameters:

(i) W —The superficial (mean) axial flow velocity (m $sec^{-1}$)

(ii) Ω—The angular velocity of the inner or outer cylinder (rad $sec^{-1}$)

(iii) β—The ratio of axial to rotational time scales (β=HΩ/W) (dimensionless).

Only two of these operational parameters are independent.

Finally, there are one or more dimensionless flow parameters that are a function of the fluid properties and flow conditions. For example, for Newtonian fluids, axial and rotational flow Reynolds numbers are, $$Re_{ax} = \frac{2\rho WR}{\mu} \text{ and } Re_{az} = \frac{\rho\Omega R^2}{\mu}.$$

These are related to Ω and W and their values may affect the choice of parameters for optimum heat exchange.

For non-Newtonian fluids there will be other non-dimensional parameters that will be relevant, e.g. the Bingham number for psuedo-plastic fluids, the Deborah number for visco-elastic fluids, etc. The fluid parameters interact with the geometric and operational parameters in that parameters can be adjusted, or tuned, for optimum heat exchange for each set of fluid parameters.

The heat exchanger's geometric and operational specifications are dependent on the rheology of the fluid, the required volumetric through-flow rate, desired shear rate range and factors such as pumping energy, available space, etc., desired overall temperature change or heating or cooling rate. The basic procedure for determining the required parameters is as follows: (Note that steps (ii), (iii) and (iv) are closely coupled and may need to be iterated a number of times to obtain the best mixing)

(i) Given the space and pumping constraints, fluid rheology, desired volumetric flow rate and desired shear rate range (if important) the radius, R, and the volumetric flow rate (characterised by W) can be determined.

(ii) Based primarily on fluid rheology, specify the window opening, $\Delta$.

(iii) Factors such as fluid rheology, space requirements, pumping energy, shear rate etc. will then determine the choice of H and $\Omega$ (for example whether the rotation rate is low and the windows are long, or whether the rotation rate is high and the windows are short). H and $\Omega$ are chosen in conjunction with W and R to obtain a suitable value of $\beta$.

(iv) Once $\Delta$ and $\beta$ are specified, the angular offset $\Theta$ is specified to ensure good heat exchange.

(v) The axial window gap $Z_J$ is then specified, and is determined primarily by $\Theta$ and engineering constraints.

(vi) Finally the number of windows, N, is specified based on the operation mode of the heat exchanger (in-line, batch) and the desired outcome of the heat exchange process.

An optimum selection of the parameters $\Delta$, $\beta$ and $\Theta$ cannot be determined directly from the fluid parameters alone —the design protocol outlined above or an equivalent should be followed. As part of this process, the parameter space must be systematically completed using a numerical algorithm fast enough to give complete parameter solutions. This procedure ultimately identifies a small subset of the full parameter space in which the best heat exchange occurs. Once this subset is found, the differences in heat exchange between close neighbouring points within the subset is small enough to be ignored. Thus any set of parameters within this small subset will result in good heat exchange. For a given application, more than one subset of good heat exchange parameters may exist, and the design procedure will locate all such subsets.

Heat is transported in the heat exchanger via advection and diffusion, and the dimensionless Peclét number characterises the ratio of rates of these processes. The control (design and operating) parameters determine the flow field and the Peclét number, and can be adjusted to optimise heat exchange within the device. Each of these control parameters has a practical range over which it may vary and so in combination, there exists a control parameter "space" for the heat exchanger. Any specific combination of these parameters represents a single point in the control parameter space, and optimisation of the heat exchanger corresponds to identification of good and robust operating point in this space for heat transfer. There exists many local optima within this parameter space. However, it is desirable to determine the operating point which provides for good heat exchange whilst being robust. That is, good heat exchange should be provided whilst allowing for some "movement" of operating parameters so that heat exchange is not compromised by a slight change in the operating parameters of the heat exchanger. To do so, the heat transfer characteristics of the device need to be determined to very high resolution over the entire parameter space. This is best done by a numerical solution of the heat transfer characteristics of the device. This method allows exploration of the heat transfer characteristics of the device over the parameter space, and so the global optimum can be identified from this information. In one preferred embodiment of the invention there are two distinct modes under which the exchanger may be operated corresponding to different heating or cooling methods. The first mode corresponds to a fixed temperature boundary condition, where efficiency of the device is measured as the rate of heat flux through outer sleeve 2. The second mode corresponds to a fixed heat flux boundary condition, where efficiency of the device is measured as the rate of temperature homogenisation within the device. An easy way to visualise this is to consider an insulated device, where the heat flux is set to zero, with initially half hot and half cold fluid; efficiency of the device is quantified by the rate at which the fluid goes to a uniform warm state. These two different modes represent separate processes in the context of optimisation, and so optimisation for each case must be considered independently.

Figure 3:
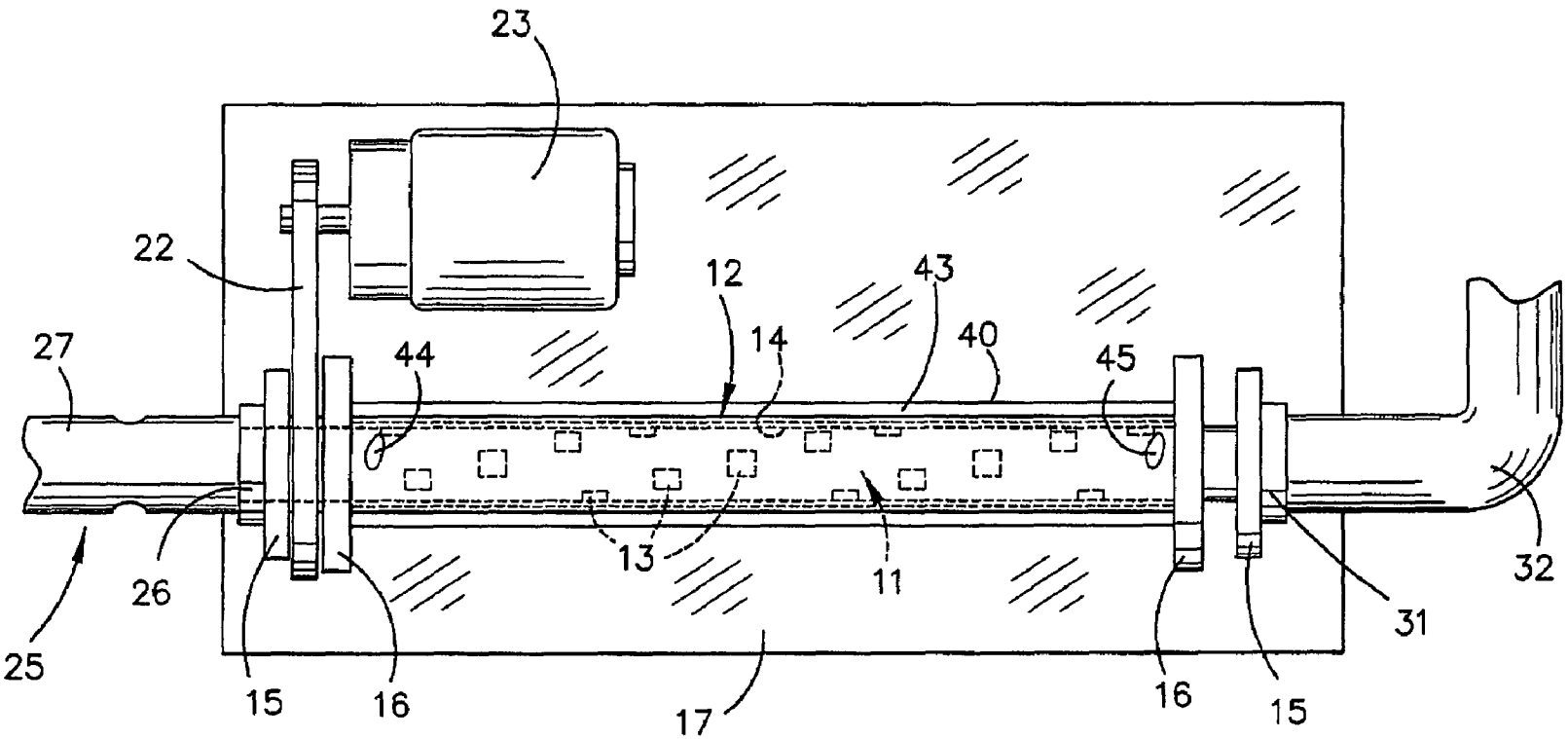
FIG. 3 is a plan view of a heat exchanger according to the first embodiment of the invention.

FIG. 3 illustrates one embodiment of a heat exchanger constructed in accordance with the invention. That exchanger comprises an inner tubular duct 11 and an outer tubular sleeve 12 disposed outside and extending along the duct 11 so as to cover openings 13 formed in the cylindrical wall 14 of the inner duct.

The inner duct 11 and the outer sleeve 12 are mounted in respective end pedestals 15, 16 standing up from a base platform 17. More specifically, the ends of duct 11 are seated in clamp rings 18 housed in the end pedestals 15 and end parts of outer sleeve 12 are mounted for rotation in rotary bearings 19 housed in pedestals 16. One end of rotary sleeve 12 is fitted with a drive pulley 21 engaging a V-belt 22 through which the sleeve can be rotated by operation of a geared electric motor 23 mounted on the base platform 17.

The duct 11 and the outer sleeve 12 are accurately positioned and mounted in the respective end pedestals so that sleeve 12 is very closely spaced about the duct to cover the openings 13 in the duct and the small clearance space between the two is sealed adjacent the ends of the outer sleeve by O-ring seals 24. The inner duct 11 and outer sleeve 12 may be made of stainless steel tubing or other material depending on the nature of the fluid.

A fluid inlet 25 is connected to one end of the inner duct 11 via a connector 26.

The downstream end of duct 11 is connected through a connector 31 to an outlet pipe 32 for discharge of the fluid.

In the heat exchanger illustrated in FIG. 3, the openings 13 are in the form of arcuate windows each extending circumferentially of the duct. Each window is of constant width in the longitudinal direction of the duct and the windows are disposed in a array in which successive windows are staggered both longitudinally and circumferentially of the duct so as to form a spiral array along and around the duct. The drawings show the windows arranged at regular angular spacing throughout the length of the duct such that there is an equal angular separation between successive windows.

As is shown in FIG. 3, the preferred embodiment of the heat exchanger has a jacket 40 which surrounds the outer sleeve 12. The jacket 40 is sealed at ends 41 and 42 to the outer sleeve 12 and defines a chamber 43 between the jacket 40 and the outer sleeve 12. The chamber 43 has an inlet 44 and an outlet 45. A heat exchange fluid is supplied to the inlet 44 and leaves the outlet 45. In the embodiment where the heat exchanger is to heat fluid within the inner duct 11, the heat exchange fluid is a hot fluid such as hot water which heats the outer sleeve 12 so that heat exchange takes place between the sleeve 12 and the fluid within the duct 11 in the region of the openings 3 as the openings move over the inner surface of the sleeve 5.

The relative movement between the closely fitted sleeve 12 and the duct 11 causes relative movement between the windows 13 and the peripheral wall of the sleeve 12 and those parts of the sleeve 12 covering the openings 13 in directions across the openings to create viscous drag on the fluid within the duct 11, generating transverse peripheral flows of fluid within the duct simultaneously in the vicinity of all of the windows 13. That is, the relative motion imparts a flow to the fluid in the duct 11 that has a component that is transverse to the direction of the bulk flow of the fluid through the duct 11.

Figure 4:
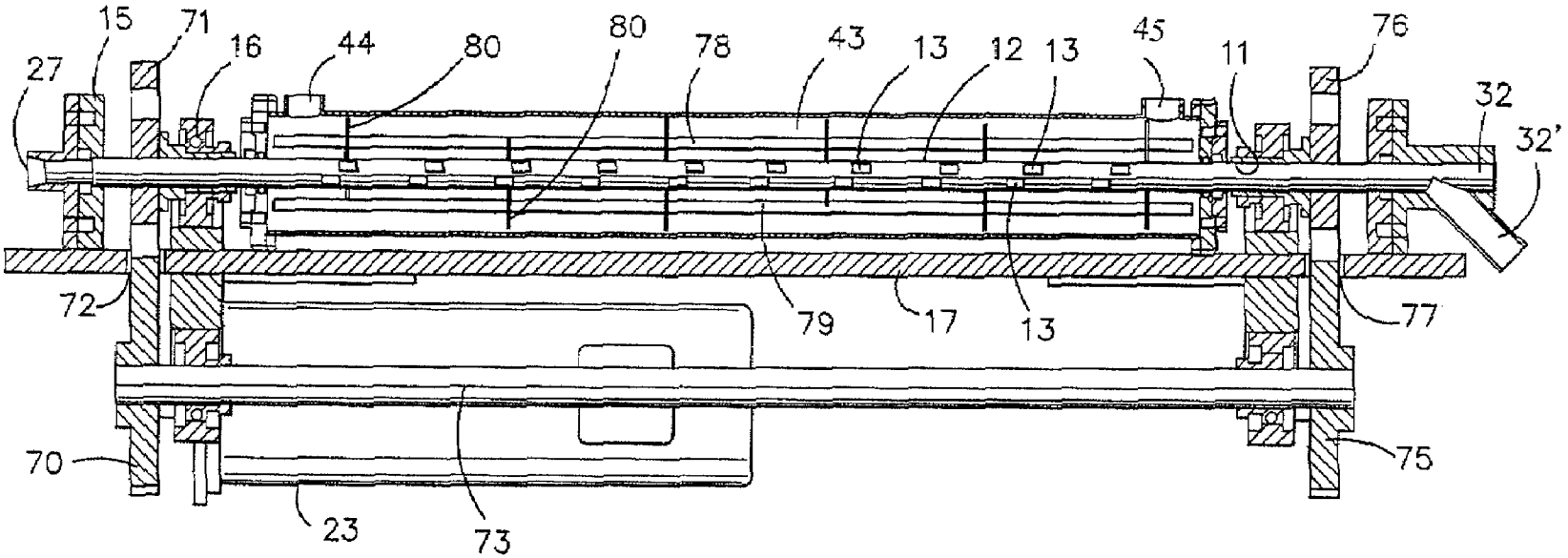
FIG. 4 is a side view of a further embodiment of the invention.
Figure 5:
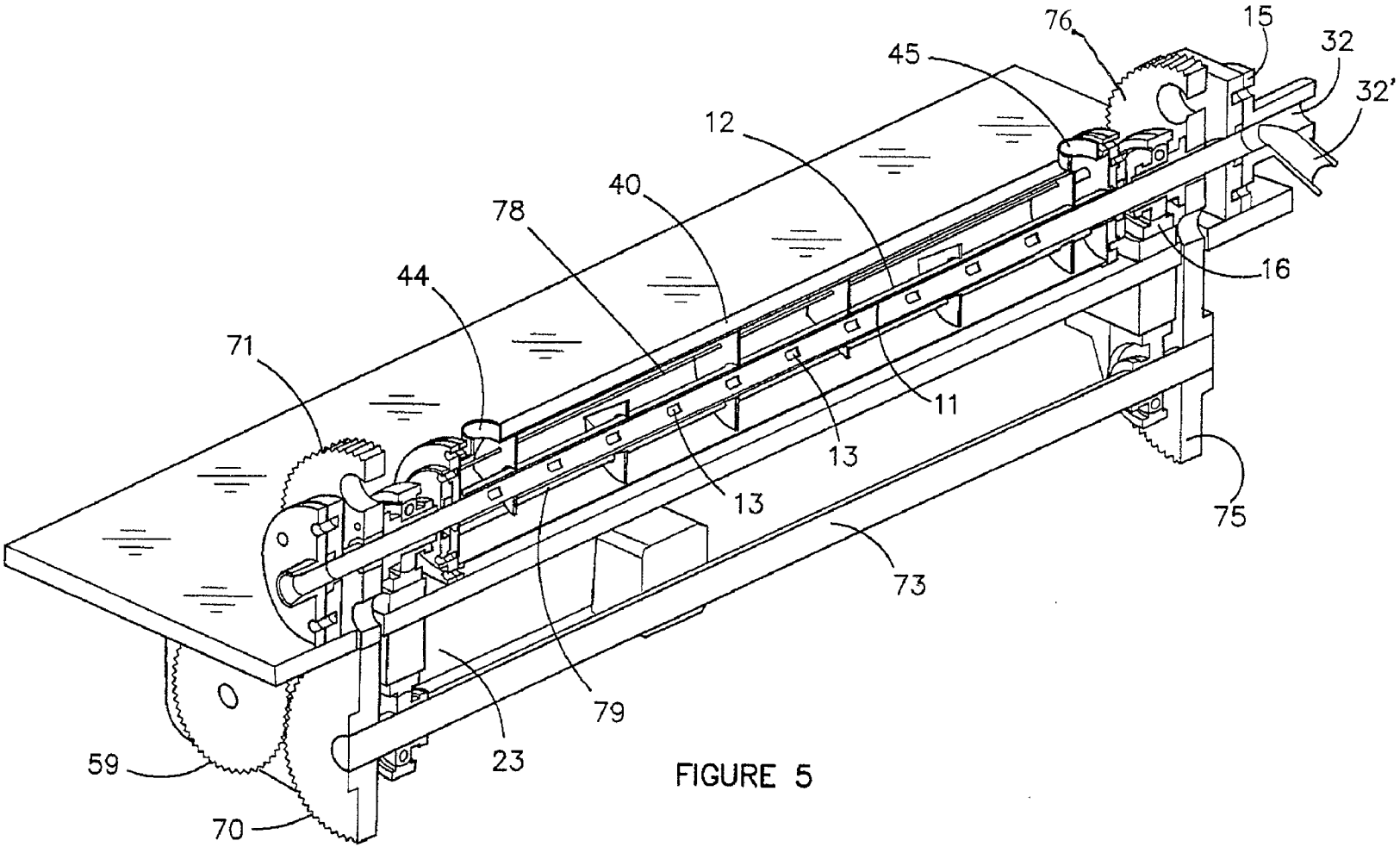
FIG. 5 is a cut-away perspective view of the embodiment of FIG. 4.

FIGS. 4 and 5 show a second and more preferred embodiment of the invention in which the jacket 40 is used to define a chamber to receive heat exchange fluid. In this embodiment the inner duct 11 is rotated and the outer sleeve 12 is stationary.

With reference to FIGS. 4 and 5, in which like reference numerals indicate like parts to those described with reference to FIG. 3, motor 23 drives a drive gear 59 which drives gear 70 which in turn meshes with a gear 71 through an opening 72 in platform 17. The gear 70 is fixed to a drive shaft 73 which in turn drives a second gear 75 which in turn meshes with a gear 76 via opening 77 in the platform 17. The gears 71 and 76 are drivingly connected to inner duct 11 so that the inner duct 11 is rotated with the gears 71 and 76. The gears 71 and 76 and the drive shaft 73 are provided to balance rotation of the duct 11 because of the relatively thin material from which the duct is used to prevent twisting or buckling which may occur if drive is provided at only one end of the duct 11. The duct 11 is provided with the windows 13 in the same manner as previously described. Jacket 40 surrounds the sleeve 12 and is provided with bars 78 and 79 which support part circular baffles 80 which are staggered with respect to one another so that fluid flow from inlet 44 to outlet 45 is caused to take a somewhat tortuous or convoluted path around the baffles 80 to provide good contact with the sleeve 12 to prevent any "short circuiting" which may occur if the fluid flows along the outside of the jacket 40 to the outlet 45 and therefore reduce heat contact of the fluid within the chamber 43 with the outer sleeve 12.

As also shown in FIGS. 4 and 5, the outlet pipe 32 may be in the form of a part which is co-axial with the duct 11. or arranged at an angle to the duct 11 as shown by reference 32'.

Figure 6:
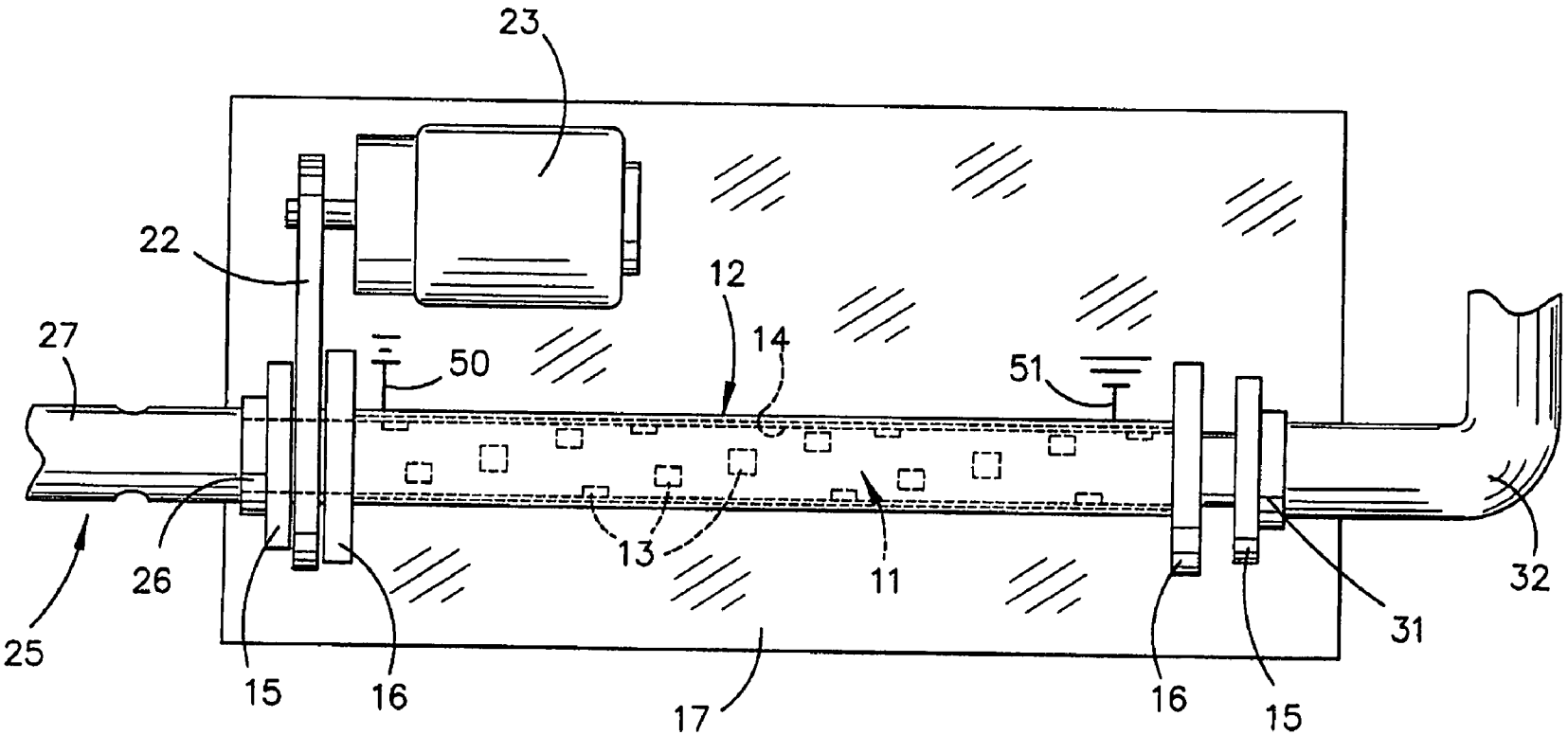
FIG. 6 is a view of a heat exchanger according to a second embodiment of the invention.
Figure 7:
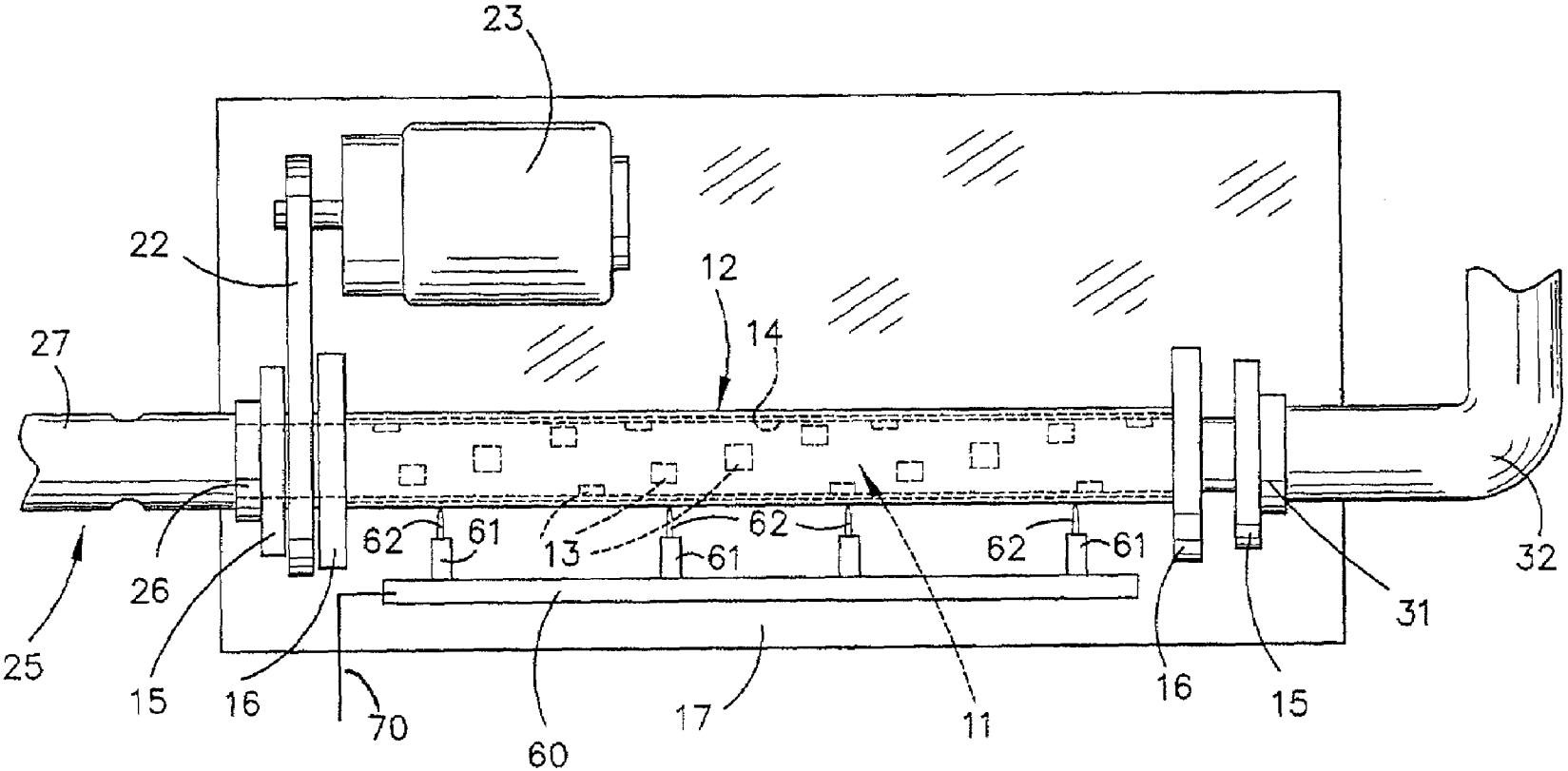
FIG. 7 is a view of a heat exchanger according to a third embodiment of the invention.

FIGS. 6 and 7 show second and third embodiments of the heat exchanger in which like reference numerals indicate like parts to those previously described.

In FIG. 6 a conductor 50 is schematically shown for supplying an electric current to outer sleeve 12. An earth conductor 51 may be provided at the other end of the outer sleeve 12 so ohmic resistance of the sleeve 12 causes heating of the sleeve 12 to provide heat exchange to the fluid in the duct 11 in the region of the windows 13.

In a modification to the embodiment of FIG. 6, the electric current can be supplied to the duct 11, in which case the duct 11 can remain stationary and the sleeve 12 rotated.

The third embodiment is shown in FIG. 7 in which a burner arrangement 60 is provided. The burner arrangement 60 has a fuel line 70 for delivering fuel to the burner arrangement 60 which then supplies the fuel to burners 61 so that flames 62 are provided for heating the outer sleeve 12. The flames 62 may have different intensities along the length of the sleeve 12.

Since modifications within the spirit and scope of the invention may readily be effected by persons skilled within the art, it is to be understood that this invention is not limited to the particular embodiment described by way of example hereinabove.

In the claims which follow and in the preceding description of the invention, except where the context requires otherwise due to express language or necessary implication, the word "comprise", or variations such as "comprises" or "comprising", is used in an inclusive sense, i.e. to specify the presence of the stated features but not to preclude the presence or addition of further features in various embodiments of the invention.

The invention claimed is:

1. A heat exchanger comprising:

an elongate hollow body having a peripheral wall surrounding a hollow interior providing a fluid flow passage;

a fluid flow inlet for admission of a fluid into one end of the fluid flow passage;

a fluid flow outlet for outlet of the fluid from the other end of the fluid flow passage;

a series of openings formed in the peripheral wall of the hollow body;

a sleeve closely fitted about and extending along the peripheral wall of the hollow body so as to cover all of said openings and to close the fluid flow passage against flow of fluid to and from the fluid flow passage through the openings;

a drive for imparting relative motion between the peripheral wall of the elongate hollow body and the closely fitted sleeve such that there is relative movement between the openings in the peripheral wall of the hollow body and those parts of the sleeve covering the openings to create viscous drag on the fluid flowing within the fluid flow passage generating transverse peripheral flows of fluid within that passage simultaneously in the vicinity of all of the openings; and a temperature control device for heating or cooling at least one of the sleeve and the elongate hollow body so that the fluid is subjected to heat exchange.

2. The heat exchanger of claim 1, wherein the peripheral wall of said body and the inner peripheral surface of the sleeve are of concentric cylindrical configuration.

3. The heat exchanger of claim 2, wherein the sleeve is of circular cylindrical form.

4. The heat exchanger of claim 1, wherein the drive is a motor for rotating one of the hollow body and the sleeve.

5. The heat exchanger of claim 1, wherein the openings are in the form of arcuate windows each extending circumferentially of the peripheral wall of the hollow body.

6. The heat exchanger of claim 5, wherein each window is of constant width in the longitudinal direction of the hollow body.

7. The heat exchanger of claim 5, wherein the windows are disposed in an array in which successive windows are staggered both longitudinally and circumferentially of the peripheral wall of the hollow body.

8. The heat exchanger of claim 5, wherein a series of said windows is disposed at regular circumferential angular spacings about the peripheral wall of the hollow body.

9. The heat exchanger of claim 8, wherein the series of windows is one of a plurality of such series in which the windows of each series are disposed at equal angular spacing, but there is a differing angular spacing between the last window of one series and the first window of a succeeding series.

10. The heat exchanger of claim 1, wherein the temperature control device comprises an outer jacket arranged about the sleeve to define a chamber between the jacket and the sleeve, the chamber having an inlet for receiving a heat exchange fluid to control the temperature of the outer sleeve, and an outlet for discharge of the heat exchange fluid.

11. The heat exchanger of claim 10, wherein a plurality of baffles are arranged between the jacket and the sleeve to cause the heat exchange fluid to traverse around the baffles and therefore to make good contact with the sleeve during passage of the heat exchange fluid in the chamber.

12. The heat exchanger of claim 1, wherein the temperature control device comprises an electric heating element for supplying electric current to one of the sleeve of the hollow body to heat the said one of the sleeve and the peripheral wall of the hollow body by ohmic resistance of the sleeve or the hollow body.

13. The heat exchanger of claim 1, wherein the temperature control device comprises a series of burners for providing flames of varying intensities along an outer surface of the sleeve.

14. The heat exchanger of claim 1, wherein the temperature control device comprises an electric heating element incorporated in one of the hollow body and the sleeve.

15. A heat exchange method comprising:

providing a fluid flow through an elongate fluid flow duct having a peripheral wall provided with a series of openings and encased within a closely fitted sleeve disposed about and extending along the peripheral wall of the duct so as to cover all of said openings and to close the fluid flow duct against flow of fluid to and from the fluid flow duct through the openings;

imparting relative motion between the duct and the sleeve such that there is relative movement between the openings in the peripheral wall of the duct and those parts of the sleeve covering the openings to create viscous drag on the fluid flowing within the fluid flow duct generating transverse peripheral flows of fluid within that duct simultaneously in the vicinity of all of the openings; and controlling the temperature of at least one of the sleeve and the duct so that the fluid is subjected to heat exchange.

16. The method of claim 15, wherein the temperature control takes place by arranging an outer jacket about the sleeve to define a chamber between the jacket and the sleeve, and supplying a heat exchange fluid to the chamber to control the temperature of the sleeve.

17. The method of claim 15, wherein the temperature control takes place by supplying an electric current to one of the outer sleeve or the duct to heat the said one of the outer sleeve and duct by ohmic resistance of the outer sleeve or duct.

18. The method of claim 15, wherein the temperature control is provided by a series of burners for providing flames of varying intensities along an outer surface of the sleeve.

* * * * *